United States Patent [19]

Linska

[11] Patent Number: 4,766,811

[45] Date of Patent: Aug. 30, 1988

[54] APPARATUS FOR AND METHOD OF PROTECTING THE CIRCUMFERENTIAL SURFACE OF A PRINTING CYLINDER AND PROTECTIVE CYLINDER

[75] Inventor: Rudolf Linska, Alsmoos, Fed. Rep. of Germany

[73] Assignee: M.A.N.-ROLAND Druckmaschinen Aktiengesellschaft, Offenbach am Main, Fed. Rep. of Germany

[21] Appl. No.: 925,813

[22] Filed: Oct. 30, 1986

[30] Foreign Application Priority Data

Nov. 8, 1985 [DE] Fed. Rep. of Germany ..... 3539586

[51] Int. Cl.[4] ..... B41F 27/00; B41F 29/00

[52] U.S. Cl. ..... 101/415.1; 101/382 R; 156/215; 156/291

[58] Field of Search ..... 101/415.1, 378, 382, 101/DIG. 12; 156/86, 215, 291

[56] References Cited

U.S. PATENT DOCUMENTS

| | | | |
|---|---|---|---|
| 2,977,876 | 4/1961 | Myers | 101/415.1 |
| 3,347,162 | 10/1967 | Braznell et al. | 101/415.1 |
| 3,353,481 | 11/1967 | Antonucci | 101/382 R |
| 3,614,926 | 10/1971 | Brechtel | 101/415.1 |
| 3,828,672 | 8/1974 | Gazzola et al. | 101/415.1 |
| 3,857,745 | 12/1974 | Gransch et al. | 156/215 |
| 3,930,852 | 1/1976 | Tanaka et al. | 101/415.1 |
| 4,092,925 | 6/1978 | Fromson | 101/415.1 |
| 4,537,129 | 8/1985 | Heinemann et al. | 101/415.1 |
| 4,599,943 | 7/1986 | Kobler | 101/217 |
| 4,626,462 | 12/1986 | Kober et al. | 156/291 |
| 4,687,530 | 8/1987 | Berscheid et al. | 156/215 |

FOREIGN PATENT DOCUMENTS

| | | | |
|---|---|---|---|
| 2249195 | 4/1974 | Fed. Rep. of Germany | 101/415.1 |

*Primary Examiner*—William Pieprz

*Attorney, Agent, or Firm*—Frishauf, Holtz, Goodman & Woodward

[57] ABSTRACT

To apply a cover plate on a printing cylinder, particularly to prevent corrosion of the cylinder surface, a double-side coated adhesive foil (2) is applied to a cover plate (1, 36, 65) which is wrapped about the cylinder, so that the cover plate will be adhered to the cylinder by the double-side coated adhesive foil. To install the cover plate, the cover plate (1) with the adhesive foil applied on one side, and, upon removal of a protective strip (S), is first placed in a clamping groove (34, 47, 65) of the cylinder, temporarily secured therein to provide for the adhesive to retain maximum adhesion strength, then wrapped about the cylinder, for example by a resilient pressure roller (40) while stripping off the protective strip (S) from between the cover plate and the cylinder; the end portion of the cover plate, which is left free from adhesive foil, is then wrapped about the trailing edge (52) of the groove, angled against the groove wall, and there adhered by a liquid or contact adhesive.

18 Claims, 6 Drawing Sheets

Fig. 5
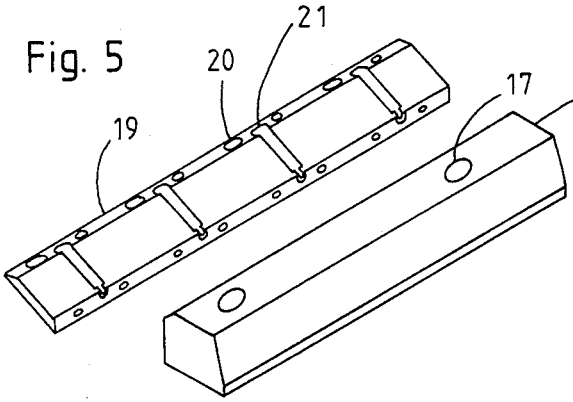
Fig. 4
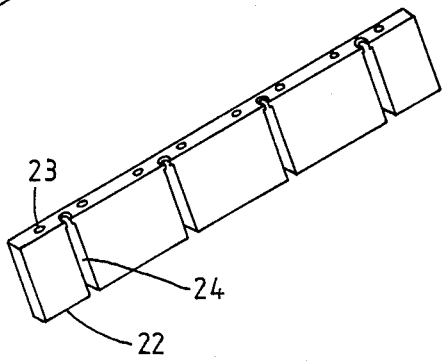
Fig. 6
Fig. 7
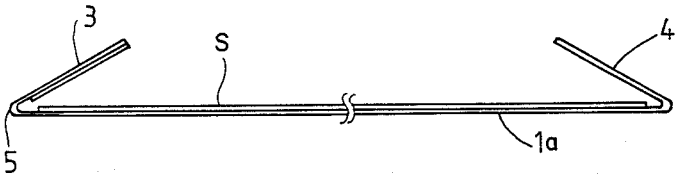
Fig. 8
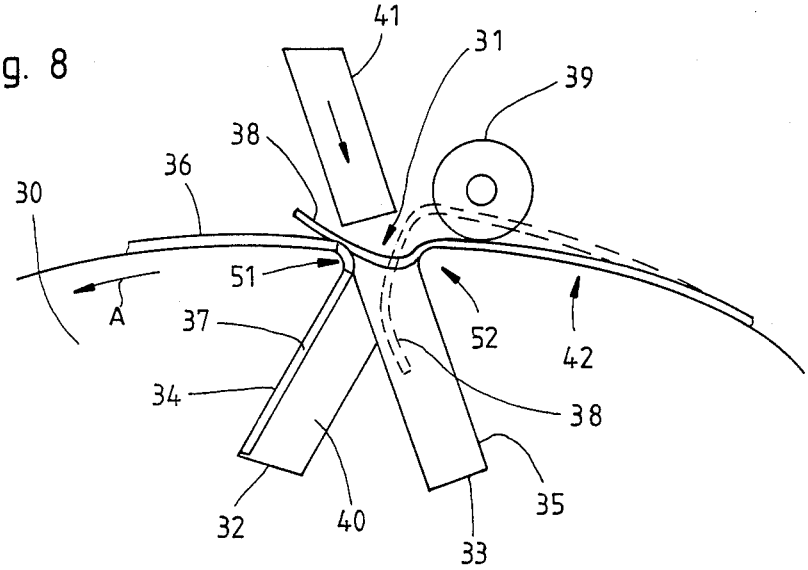

APPARATUS FOR AND METHOD OF PROTECTING THE CIRCUMFERENTIAL SURFACE OF A PRINTING CYLINDER AND PROTECTIVE CYLINDER

The present invention relates to a method to apply a protective surface covering over a printing cylinder, to an apparatus to shape such a covering if it cannot be shaped by a printing machine itself and to a so protected cylinder.

BACKGROUND

It has previously been proposed—see the referenced U.S. Pat. No. 4,599,943, Kobler, the disclosure of which is hereby incorporated by reference—to coat a printing cylinder with a ceramic coating, which ceramic coating covers both the cylinder circumference as well as the adjacent surfaces of a cylinder groove, which may be provided, and extends axially throughout the cylinder. It has also been proposed to adhere thin plates on a printing cylinder, which plates carry impression or printing data. A frame is used for a base plate, in which the plate itself is adhered. The plates cover only a portion of the circumference of the cylinder, so that the portion not covered by the cylinder is not protected against corrosive influences which may arise in operation of the machine.

THE INVENTION

It is an object to provide a method to apply a protective covering or coating on a printing cylinder which covers the circumferential surface of the cylinder and at least a portion of the side walls of an axial cylinder groove.

Briefly, a protective foil is provided which is coated on both foil sides with an adhesive. A cover plate is applied to one side of the double-sided coated adhesive of the cover plate, starting at a first end portion, which, looked at in the direction of rotation of the cylinder, will form the leading end portion. The second end portion will be left free. The second side of the adhesively coated foil is applied to a first end portion of the plate in the groove. The coated second side of the foil, with the plate adhered thereto, is applied on the circumference of the cylinder up to about the trailing edge of the groove. The trailing end portion of the plate is then applied by an adhesive to the trailing surface of the groove. The plate, adhered to the double-sided adhesive foil, thus will cover the walls of the axial groove, at least in part. The plate, preferably, is flexible. The adhesive foil will have uniform thickness, so that the plate and the adhesive foil will have the same thickness applied over the entire circumference of the cylinder. In accordance with a feature of the invention, either the printing machine or a separate application tool can be used to apply the adhesive foil free from air bubbles or other other non-uniformities.

The arrangement has the advantage that a flexible plate, reliably and continuously adhered to the cylinder, can provide an effective surface coating to the cylinder, adhered with uniform force over the entire circumferential portion of the cylinder. A double-adhesively coated foil can be made to be completely homogeneous, with homogeneous adhesive, so that the so-coated cylinder will have excellent centricity. Coating printing cylinders with chromium, nickel, ceramic substances or the like or other corrosion-resistant coatings, while effective, is an expensive procedure; applying a protective plate with an adhesive foil is substantially less expensive and, additionally, permits subsequent application of the protective cover plate to a cylinder which is already installed in a printing machine. Interchange of plates already applied to the printing cylinder can also be effected, for example by applying a corrosion-resistant plate or cover thereover.

DRAWINGS

FIG. 4 is a pictorial view of one form of a holding strip for the apparatus in FIG. 3;

FIG. 5 is a pictorial view of another type of folding strip of the apparatus of FIG. 3;

FIG. 6 shows yet another type of a holding strip for the apparatus of FIG. 3;

FIG. 7 is a schematic side view of a plate with bent-over end or edge portions;

FIG. 8 is a side view showing insertion of the plate illustrated in FIG. 2 on the cylinder of the printing machine;

DETAILED DESCRIPTION

Figure 1:
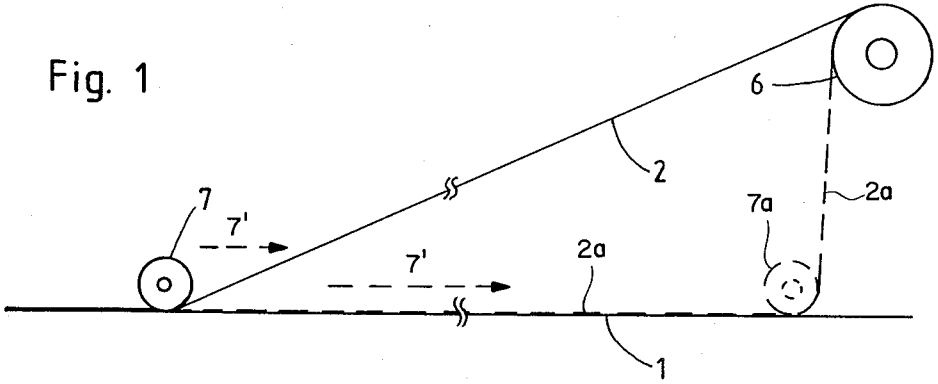
FIG. 1 shows, schematically, application of an adhesive foil to a flexible plate.
Figure 2:
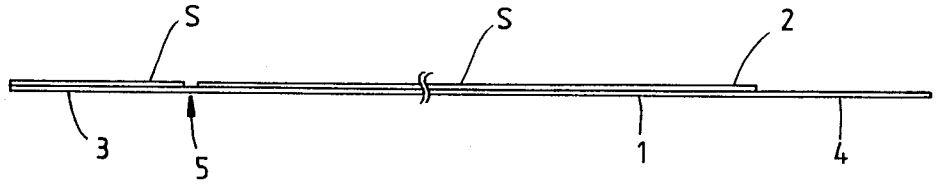
FIG. 2 is a schematic side view of a flexible plate, covered with an adhesive foil in accordance with the present invention.

Referring first to FIGS. 1 and 2: A flexible sheet or plate 1, is provided, which is made of corrosion-resistant material, for example of the material known under the tradename "Nirosta", stainless steel, or the like. The sheet, which is thin and flexible, is covered with a foil 2. Foil 2 is coated on both sides with a homogenaous adhesive layer, not visible in the drawings since it is very thin. The adhesive on the foil 2, preferably, is of the type which is immediately adherent when contacting a counter surface or counter layer. This is, is known as a contact-type adhesive. It is not necessary, however, that maximum adhesive strength is immediately obtained. Adhesives of this type are frequently referred as "single-sided contact adhesives". Other types of adhesives may be used. It is, however, important that the adhesive layer on the foil 2 is of a high degree of homogeneity, and has uniform thickness throughout.

In order to permit rolling of the foil 2, the adhesive is covered by a protective layer S which may also be thin foil material. The protective layer S, which can be stripped off, permits storing of the adhesive foil on a roll 6.

In accordance with a feature of the invention, the sheet or plate 1—see FIG. 2—is so covered with the foil 2 that the ends 3,4 of the plate 1, which are to be introduced into the axial groove of a printing cylinder, are adhered in different manner. The end 3 of the plate 1 which will form the leading end—looked at in the direction of rotation of the cylinder—is covered with the foil 2. The trailing end 4, however, will be left free from foil 2. Preferably, a gap 5 is left on the plate which is not covered with foil either, adjacent the leading end, which, as will be described in detail below, will be fitted over the leading edge of the cylinder groove.

As best seen in FIG. 1, the foil 2 is peeled off from a supply roller 6 and applied on the sheet 1 by an elastic pressure roller 7. The elastic pressure roller 7 insures uniform smooth, flat application on the flexible plate 1, without bubbles. The application pressure, axially across the roller 7, likewise will be uniform. Particular care is recommended so that the foil 2 will engage the surface 1 free from bubbles and with uniform adhesive force. The gap 5 (FIG. 2) can be formed afterwards by cutting out a small strip after the foil 2 has been applied to the plate 1 up to the terminal end portion, that is, in advance of the end of the plate 1. FIG. 2 illustrates the plate with the foil applied. The cover layer S remains on the top of the foil 2.

As schematically indicated by arrow 7', FIG. 1, the roller 7 can be moved to the position shown in broken lines at *7a* and the foil 2 will then assume the path shown in broken lines at *2a*.

In some applications, it is possible to apply the plate 1 with the foil 2 attached on the cylinder of a printing machine directly on the printing machine and to use the apparatus already present in the present machine to effect such application. In other installations, it is desirable, however, to pre-form the plate 1 before application on the cylinder of the printing machine. FIGS. 3 to 6 illustrate a bending apparatus with which the plate 1 shown in FIG. 2 can be bent or edged over at the two ends 3, 4 so that the plate can be easily connected to a printing cylinder with the ends 3, 4 in the walls of the groove of the cylinder, for subsequent adhesion therein.

The plate 1 is precisely bent where the bending edges are to meet the edges of the groove in the cylinder to which the plate is to be applied. The apparatus 8 (FIG. 3) has two side walls 9, 10 between which a pre-form, or dummy cylinder 11 is positioned. Cylinder 11 has a comparatively wide groove 12. The width and diameter of the dummy cylinder 11, which forms a bending dye cylinder, is precisely matched to the circumference of the printing cylinder with which the plate 1 is to be used.

A support rail 13 is located in the groove 12 of the dummy cylinder 11 of the apparatus 8. The support rail 13 extends parallel to one side wall of the groove 12, and is located close thereto. The spacing of the support rail 13 to the other side wall 15 of the groove preferably is slightly greater than the spacing between the support rail 13 and the first wall 14. This permits insertion of the insert strip 16 in the bottom of the groove 12. Strip 16 is formed with through-holes 17 to permit passage of screws therethrough, to be received in matching tapped holes within the bottom of the groove 12. A tension and holding strip 22—see FIG. 6—is located between the side of the insert strip 16 and the wall 15 of the groove. A holding and positioning strip 19 (FIG. 5) is insertable between the support rail 13 and the wall 14.

The holding and positioning strip 19 and the tensioning and holding strip 22 are formed with through-holes 20, 23, respectively, and eccentric holes 21, 24, respectively. Eccenters are inserted in the eccentric holes, and eccentrically adjustable, for example with an Allen wrench which, upon rotation, can be turned or twisted out of the lateral surfaces of the strips 19, 22, respectively. Threaded holes 18 are located in the bottom of the groove 12.

Operation—Pre-Bending and Edging of a Plate

The plate of FIG. 2 can be accurately bent with the edges precisely perpendicular to the lateral walls of the plate. First, the end 3 is so inserted in the groove 12 that the end 3 is engaged by the wall 14. The protective strip S remains on the plate 2. After the plate is inserted in the groove, the holding and positioning strip 19 (FIG. 5) is inserted between the wall 14 and the support rail 13. The positioning strip 19 is secured by screws in suitable holes formed in the bottom of the groove 12. The rotatable eccenters in the eccentric holes 21 permit engagement against the wall 14 of the groove or, rather, against the end 3 of the plate 1 which is placed against the wall 14. This provides for precise and exact attachment and placing of the plate 3 in position.

The cylinder 11 is then rotated, manually or by a motor (not shown). An elastic pressure roller 25—see FIG. 3—rotatably secured between the side walls 10, 11, provides edged angling-off of the previously fixed end 3 of the plate 1 about the edge of the cylinder 11. Upon continued rotation of the cylinder 11, plate 5 is rolled off on the circumference of the cylinder 11 until the pressure roller 25 forms the edge at the other end of the plate, namely the end 4, pressing the plate into the groove 12. The pressure roller 25, thus, will precisely terminate the trailing edge formation of the plate 1. The end 4 of the plate 1 is then placed against the second wall 15 of the groove 12.

The final angling and edging is done by placing the insert strip 16 which is already pre-assembled in the groove 12 by passing screws through the holes 17 and the tapped holes 18 in the groove. This permits attachment of the tensioning and holding strip 22, to press the end 4 of the plate against the wall 15 of the groove. Final positioning is obtained by placing eccenters in the eccenter holes 24 of the tensioning and holding strip, and rotating the eccenters to securely clamp the end 4 against the wall 15 of the groove 12. Screws passing through the bores 23 of the tensioning and holding strip 22, and engaging in matching tapped holes 18 in the groove 12, then pull the end 4 of the plate against the wall 15 of the groove and downwardly in the direction of the bottom of the groove. This terminates the edging and bending step. The end of the plate 4 is pulled downwardly along the wall 15 of the groove.

Preferably, the side of the tensioning and holding strip 22 facing the end 4 of the plate is formed with a roughened surface, for example ribbed, knurled, stippled, or the like. This increases the gripping effect on the end 4 of the plate and enhances the tensioning which can be obtained. Similar roughening of the surface preferably is also applied to the holding and positioning strip 19 (FIG. 5).

Figure 3:
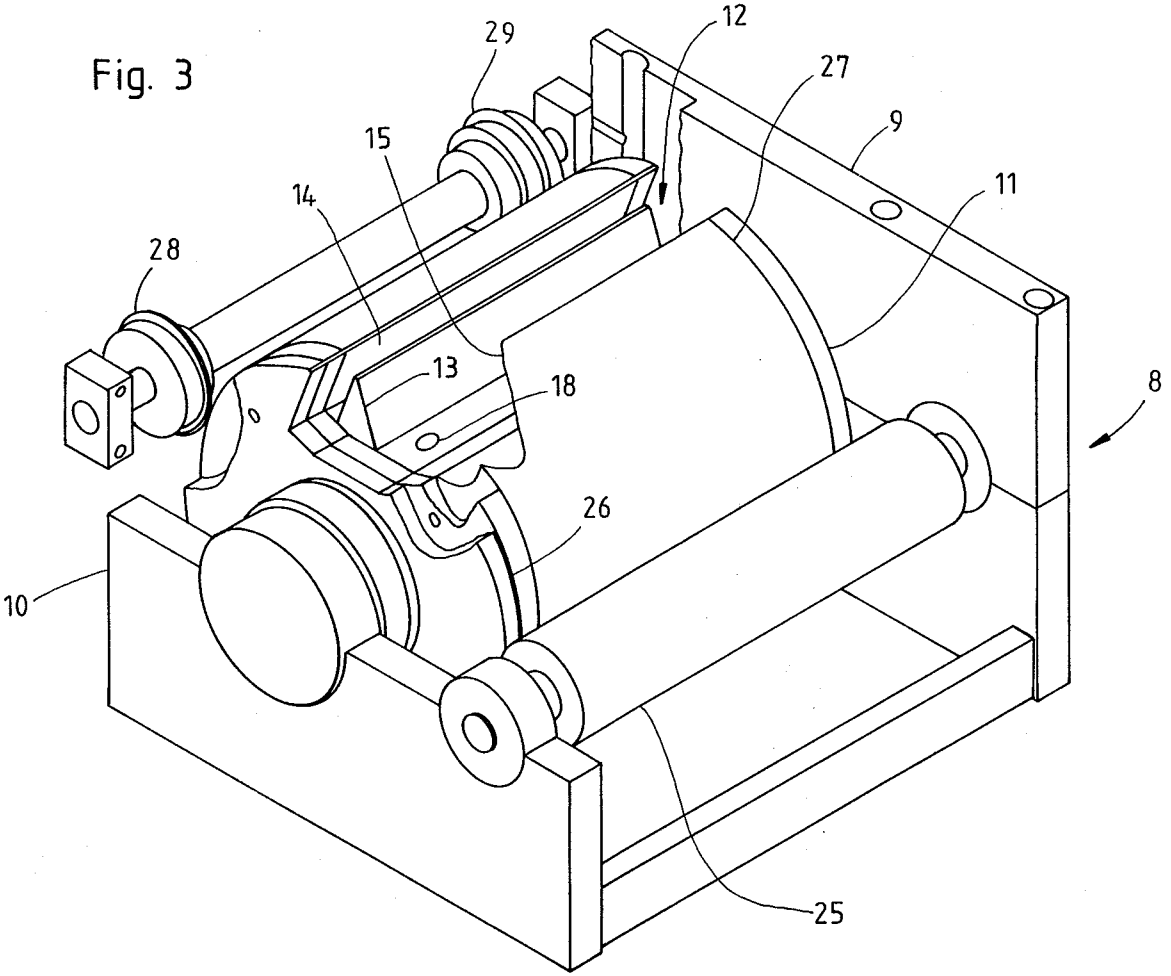
FIG. 3 is a pictorial view of an apparatus to apply an adhesive foil on a plate and bend the plate with precisely arranged bending edges.

In accordance with a preferred embodiment, the bending apparatus of FIG. 3 is formed with cutting grooves 26, 27 at the lateral circumferential surfaces in which circular or disk knives 28, 29 can engage. When the bending steps have been completed, the knives 28, 29 are engaged against plate 1, and the plate 1 can be precisely cut to the desired dimension, eliminating any warping or twist which might have occurred.

The plate 2, bent by the apparatus of FIG. 3, can be removed from the cylinder 11 by loosening the respective holding strips 16, 19, 22. The plate 2 need not remain bowed, but can relax to be essentially flat, except for the angled-over ends, as best seen in FIG. 7. This pre-bent plate 1*a* can thenbe applied, easily, on the cylinder of a printing machine.

Figure 9:
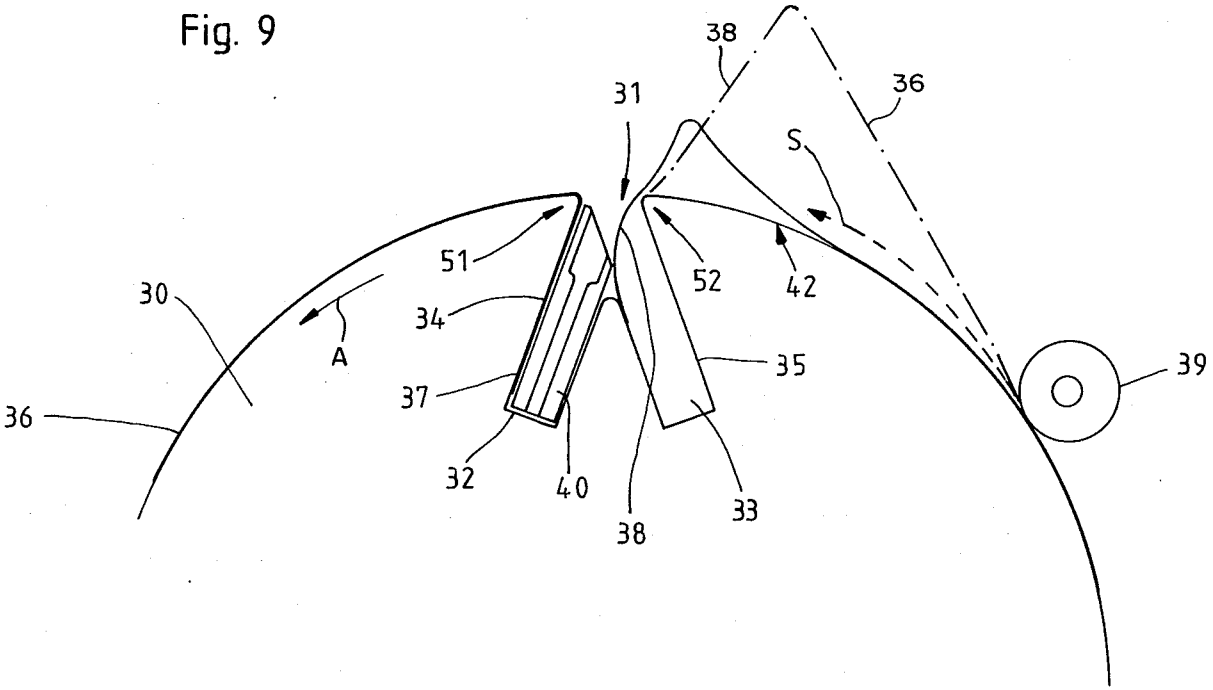
FIG. 9 is an illustration of another step in the application process of a plate to a cylinder.

It is not necessary for all applications to pre-bend a plate, as described in connection with the apparatus of FIGS. 3-6. FIGS. 8 and 9 illustrate application of a plate 36 which can be identical to plate 1 described in connection with FIG. 2, without pre-bending of the end portions 3, 4. Preferably, the steps described in connection with FIGS. 8 and 9 are used when coating a printing cylinder which is being manufactured; the steps described in connection with FIGS. 10 to 11, for application of a plate 1*a* as shown in FIG. 7,are particularly suitable for application to a cylinder which is installed in an existing printing machine.

Cylinder 30, see FIGS. 8 and 9, which may, for example, be a rubber blanket cylinder, has the usual axial groove 31, divided into two groove portions 32, 33. The walls 34, 35 are to be covered with the ends 37, 38 of a flexible plate 36 which has been covered with an adhesive foil, as shown and described in connection with FIG. 2.

The plate 36 is adhered to and applied to the cylinder 30 by use of a pressure roller 39 which is rotatable engageable with the circumference of the cylinder 30. In printing operation, cylinder 30 rotates in direction of the arrow A. During application of the protective plate, the cylinder 30 likewise rotates in the direction of the arrow A.

Initially, the protective foil S is removed from the end 37 of the plate 36, and the end 37 of the plate 36 is engaged with_the leading wall of the groove 34. A holding strip 40 is then inserted in the groove and secured to the bottom wall 32 of the groove, in any suitable manner, for example by screws or the like (not shown). The holding strip 40, preferably, is constructed similar to the holding and positioning strip 19 (FIG. 5). The cylinder 30 is then rotated, which presses the plate 36 on the circumference of the cylinder 30, by engagement with a pressure roller 39. The protective foil S must be stripped off the surface of the foil facing the cylinder 30 as the cylinder 30 rotates, that is, must be removed successively, continuously. This procedure is continued until the position of the cylinder 30 is reached which is illustrated in FIG. 8,that is, at which the trailing end 38 of the plate 36 is close to the edge of the trailing end corner 52 of the groove. The pressure roller 39 will press the trailing end 38 of the plate 36 over the trailing edge and, at least in part, into the trailing portion of the groove 31. In the rearward region of the circumference, for example at approximately the zone illustrated by reference numeral 42, the protective foil S is not immediately removed from the adhesive layer, in order to permit precise edging of the end 38 over the trailing edge. After edging of the end 38 over the trailing edge 52, roller 39, or the cylinder, is rotated in opposite direction, that is, in a direction opposite the arrow A, until the roller 39 has cleared the zone 42. This permits removal of the protective foil S and placing of the end 38 of the plate 36 into the groove 33. The pressure roller 39 then is permitted to engage the zone 42 to completely adhere the plate with its adhesive on the circumference 30 of the cylinder, up to the edge 52. This provides for precise bending of the plate 36 about the trailing edge 52 of the groove.

Before finally attaching the plate 36 entirely in the groove, the lower or inner side of the end 38 of the plate 36 and/or the wall 35 of the groove are coated with a liquid adhesive or a pressure-sensitive adhesive which, upon engagement of the end 38 in the wall 35, however, permits still some slight shifting of the end 38 with respect to the wall 35. A tensioning and holding strip 41, which may be similar to the tensioning and holding strip 22 (FIG. 6), is then inserted in the groove which, upon tightening or screwing-down of the tensioning and holding strip 41, provides for precise engagement of the plate 36 about the circumference of the cylinder 30 and stretching of the plate 36. The plate 36, thus, will be precisely positioned along the trailing edge 52, and against the wall 35 of the groove. The strips 40, 41 will remain in the portions 32, 33 of the groove until the respective adhesive materials have reached at least approximately maximum adhesive strength.

Plate 36—as seen in FIG. 8—was precisely placed about the leading edge 51 of the groove. It is particularly desirable for a placement of this type to leave the portion of the plate which will be bent around the leading edge 51—in the direction of rotation of the cylinder—free from adhesive foil. This will be the region 5.(FIG. 2) of the plate 1. Leaving the zone of the leading edge 51 free of adhesive foil prevents piling up of material at the leading edge, and corrugating of foil material about the leading edge upon edging of the plate 36. Removing foil at the bent corner substantially increases the lifetime of the coating and facilitates precise bending; leaving the foil continuous, even about the bent corner, detracts from lifetime and precision in application.

FIG. 9 illustrates, in broken lines, the position of the foil S prior to removal when the pressure roller 39 is ahead of the zone 42. The plate is shown in chain-dotted lines, separated from the foil S for ease of illustration although it is to be understood that the protective cover S is, of course, on the foil 2 of the plate 36, the showing in the Figure being merely for illustration and ease of understanding.

Figure 10:
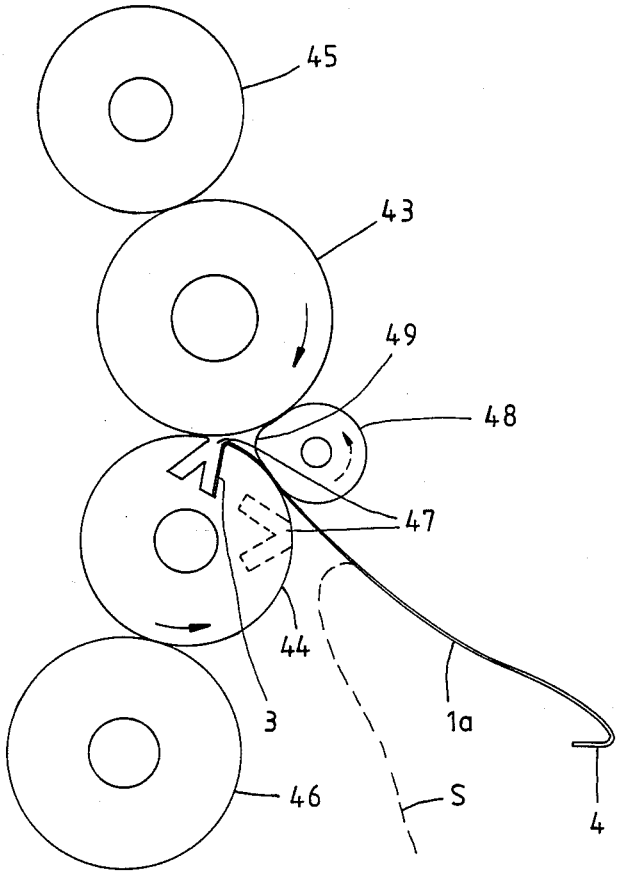
FIG. 10 illustrates application of the plate of FIG. 7 on the printing cylinder.

The plate shown in FIG. 7 can be installed on a cylinder in a printing machine with merely minor modification thereof, or by the use of a simple engagement pressure roller. Referring to FIG. 10: A rubber blanket cylinder 43, 44, with associated plate cylinders 45, 46, is shown, schematically, as used in customary rotary printing machines. Let it be assumed that subsequently, or due to necessary exchange of a protective coating, a flexible plate in accordance with the present invention is to be mounted on a printing cylinder. For purposes of illustration, attachment of the plate of FIG. 7 on blanket cylinder 44 of the printing machine will be shown. Side walls, drive gears and the like of the printing machine and any other standard components have been omitted, since not necessary for an understanding of the invention.

The pre-angled or creased plate 1*a*, see FIG. 7, is inserted in the groove of the blanket cylinder, and there secured by a holding strip, as described in connection with FIGS. 3 and 8. Thereafter, the two blanket cylinders 43, 44 are rotated slowly. A deformable elastic pressure roller 48 is engaged between the blanket cylinders 43, 44. The deformation region 49—shown exaggerated in FIG. 10—will provide for uniform and substantial engagement pressure against the circumference of the cylinder 44. The pressure roller 48 will be drawn somewhat between the blanket cylinders 43, 44. As the plate 1*a* is rolled on the cylinder 44, the protective foil S is continuously stripped off, as schematically shown in FIG. 10 by the broken line, to provide for adhesion of the plate 1*a* on the circumference of the cylinder 44. The pressure roller operates with low speed, since it is separated from the blanket cylinder 43.

Figure 11:
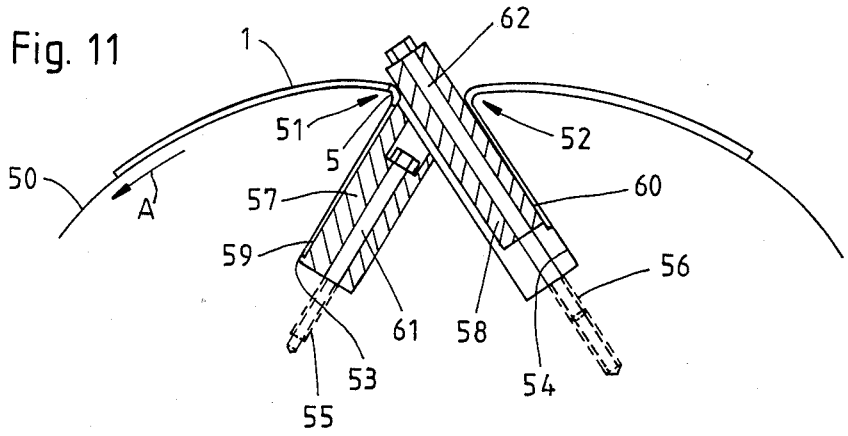
FIG. 11 is a part-sectional side view showing a holding arrangement for the plate applied in accordance with FIG. 10.

When the blanket cylinder 44 with the groove 47 has reached the position shown in which the groove 47 is shown in broken lines, the end 4, which is left free of the adhesive foil, can be inserted in the groove. FIG. 11 illustrates a suitable arrangement for this insertion, which can also be used in connection with the attachement arrangement and method in accordance with FIGS. 8 and 9.

FIG. 11 illustrates a cylinder 50 which, for example, is a rubber blanket cylinder, covered with a plate 1 or 1*a*, in accordance with either FIG. 2 or FIG. 7. The leading edge 51—looked at in the direction of rotation of the cylinder as shown by arrow A is covered by the plate 1 in the region of the gap 5 (see FIG. 2). Preferably, no adhesive is located immediately adjacent the upper surface region of the trailing edge 52.

The leading and trailing edges 3, 4 of the plate 1 are secured to the walls 53, 54 of the groove as previously described, using, for example, holding strips 57, 58 which can correspond to the strips 19 or 22, described in connection with FIGS. 5 and 6, respectively. The strips press the ends 59, 60 of the plate against the walls 53, 54, respectively, of the groove. The trailing end 60 is tensioned in the direction of the bottom wall of the groove, for example by tightening screws passing through the strips into tapped holes on the bottom of the groove, with the strips having a roughened surface to provide for application for tension to the plate. The grooves are formed with suitable tapped holes 55, 56, in which screws, not further shown, are carried through the holes 61, 62 in the strips 57, 58. After drying and/or curing of the respectively used adhesive, the strips 57, 58 can be removed. The coating or covering process of the cylinder is then terminated.

Figure 12:
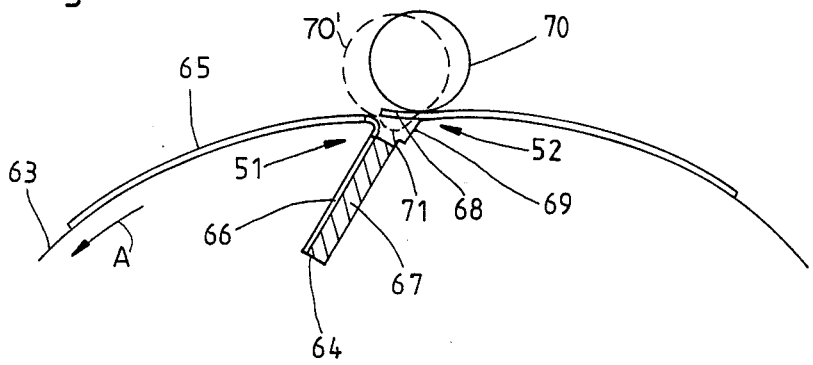
FIG. 12 illustrates coating of a plate cylinder having a single small cylinder slot by a plate applied in accordance with the present invention.

FIG. 12 illustrates a desirable modification in accordance with the invention. Plate cylinder 63 has a printing plate or forme which can have its ends located in a single narrow axial cylinder slot 64. Cylinders of this type also can be covered in accordance with the method of the present invention with an elastic cover plate. Elastic plate 65, which is similar in structure to the plate of FIG. 2, is applied on the cylinder 63. The leading end 66—looked at in the direction of rotation of the cylinder 63, see arrow A—of plate 65 is first placed in or against one wall of the cylinder slot 64, by use of a strip 67 in accordance with the method described in connection with FIGS. 7 and 8. This also determines the edge position of the plate 65. Preferably, the cylinder slot 64 is formed with a recess 69 adjacent the trailing edge 52. The length of the plate 65 to be adhered on the circumference of the cylinder 63 is so dimensioned that the trailing end 68 of the plate—see FIG. 12—extends only so far over the trailing edge 52 of the cylinder as the cylinder slot is wide. A resilient pressure roller 70 is engaged on the circumference of the plate cylinder; pressure roller 70 may be similar to the pressure roller 39. After rolling on of the plate 65, the trailing end of the plate 68 is pressed into the recess 69 by deformation of the pressure roller 70, as shown in broken lines at 70'. It should be noted that the pressure roller, when deformed as shown at 70', will form a bulge 71 engaging within the slot 64 and pressing the end of the plate 63 against the recess 69. To adhere the plate, adhesive is applied before this final engagement step against the end of the plate and/or the wall of the recess 69—preferably on the wall of the recess 69. In this embodiment, it is also possible to leave a narrow strip of adhesive foil on the trailing end 68 of the plate. This, however, is not a preferred way of carrying out the invention; it is more difficult to handle. Use of a liquid adhesive or a pressure-sensitive adhesive, preferably applied to the wall 69, is the easiest and preferred.

The method in accordance with the present invention permits uniform bubble and crease-free application of a protective cover or coating on a printing cylinder by applying a flexible plate on the surface. The adhesive force of the flexible plate will be uniform over the entire circumference of the printing cylinder which, given by the homogeneity of the adhesive will result in excellent centricity of the so covered cylinder, which, then, will be effectively corrosion-resistant. It is a specific advantage of the present invention that expensive processes of coating cylinders with ceramics or plating cylinders with chromium, nickel or the like or otherwise applying corrosion-resistant layers can be carried out substantially cheaper and easier. Further, the method permits subsequent application of a coating plate or cover to a cylinder which is already installed on a printing machine or applying a cover to a cylinder upon removal of a cylinder from a printing machine for exchange, in a simple and inexpensive manner.

I claim:

1. Method of protecting the circumferential surface of a printing cylinder (30, 44, 50, 63) and adjacent surface portions of the walls of a cylinder groove (34, 47, 65), comprising the steps of providing a cover plate (1, 36, 65);

providing a protective foil (2) which is coated on both foil sides with a contact, pressure sensitive adhesive, one side of the double-side coated adhesive foil (2) being adhered to a side of the cover plate (1), starting at a first end portion (3, 68, 69) of the cover plate, and forming the leading end portion—in the direction of rotation of the cylinder—while leaving a second end portion (4) of the cover plate (1) free from the foil;

applying the first end portion (3, 68, 69) of the cover plate (1) on the printing cylinder by pressing, and thus adhering the first end portion of the adhesively coated second side of the foil against the leading wall of the groove (31, 47, 64);

applying the cover plate (1, 36, 65) thereto on the circumference of the cylinder up to about the trailing edge of the groove by pressing, and thus adhering the adhesively coated second side of the foil on the circumference of the printing cylinder; and separately adhering the trailing end portion (4, 38, 68) of the plate (1, 36, 65) to the trailing surface (35, 54, 69) of the groove.

2. Method according to claim 1, wherein the step of adhering the trailing end portion (4, 38, 68) of the cover plate (1, 36, 65) to the trailing surface (35, 54, 69) of the groove comprises adhering said trailing end portion of the cover plate by a liquid adhesive.

3. Method according to claim 1, wherein the double-side coated adhesive foil (2) applied to the cover plate is formed with a gap (5) in the region of the first or leading end portion (3) of the cover plate said gap being positioned in the region of the leading edge (51) of the cylinder when the cover plate (1) is installed on the printing cylinder.

4. Method according to claim 1 wherein a protective foil or layer (S) is applied to the double-side coated adhesive foil (2) at the side remote from the side which is adhered to the cover plate (1);

and wherein the step of pressing and adhering the coated second side of the foil, with the plate adhered thereto, on the printing cylinder comprises engaging a pressure roller (7) with the plate and peeling or stripping off the protective foil or layer (S) from between the double-side coated adhesive foil and the cylinder while relatively rolling off the cylinder and said pressure roller against each other.

5. Method according to claim 4, further including the step of providing a precision edge bending apparatus (FIG. 3) including a rotatable cylinder (11);

and further including the step of pre-creasing or angling off at least one of the end portions (3,4) of the plate (1) by engaging the at least one end portion against a grooved edge of the cylinder (11) with a pressure roller (25).

6. Method according to claim 1, wherein at least the first end portion (3) of the cover plate (1) is precreased at a position where the first end portion is fitted over the leading edge (51) of the cylinder groove (34, 47, 65);

wherein (FIG. 10) the step of pressing and adhering the precreased, leading end portion (3) against the leading wall (35) of the printing cylinder groove includes retaining in position the so-adhered leading end portion by a first holding strip (40) pressed against the wall of the groove;

the step of pressing and adhering the plate on the cylinder includes rotating the printing machine cylinder (44) while engaging a pressure roll (48) against the cover plate (1);

and wherein the step of adhering the trailing end portion of the plate comprises flexing the trailing end (4) of the plate to fit into the groove, adhering the trailing end against the trailing wall (54) of the groove and engaging a second holding strip against the plate in the groove, and tightening said second holding strip towards the bottom of the groove to stretch said cover plate about the circumference of the cylinder.

7. Method according to claim 6, wherein the pressure roller (48) includes a highly elastic circumferential jacket;

said printing machine cylinder forms one cylinder of a pair (43, 44), the pressure roller being located adjacent the nip of the pair;

and wherein the step of rotating the cylinder on which the cover plate is to be applied, with the pressure roller engaged, includes the step of drawing a surface portion of the pressure roller (48) towards the nip of the cylinders of the pair.

8. Method according to claim 1, wherein the step of adhering and pressing the cover plate (1) on the cylinder (30) includes retaining said first end portion of the adhered foil securely against the wall (34) of the cylinder by a first holding strip (40);

fitting the cover plate over the leading edge (51) of the groove (31) of the cylinder to angle off or crease the cover plate over the edge of the cylinder at the groove; and the step of pressing and adhering the plate on the cylinder includes engaging a pressure roller (39) with an elastic circumference with the cover plate (1) and rolling off the cylinder (30) against the pressure roller, while peeling or stripping off a protective foil (S) from the second side of the double-side coated adhesive foil (2) in advance of engagement of the pressure roller with the cover plate until a trailing region (42) of the cylinder—with respect to the cylinder groove—is reached;

leaving the protective foil (S) on the cover plate and continuing to engage the pressure roller (39) with the cover plate until the pressure roller, with the cover plate thereon, reaches the trailing edge (52) of the groove;

angling off and creasing the cover plate over the trailing edge (52) of the groove;

reversing rotation of the cylinder until the trailing zone of the cover plate has been reached where the protective foil (S) has not been stripped off;

then stripping off and peeling off the remainder of the protective foil (S) while rolling off the pressure roller (39) against the circumference of the printing cylinder (30) in said first direction of rotation until the cover plate (1) is adhered to and reaches the trailing edge (52) of said printing cylinder;

then carrying out the step of adhering the trailing end portion (38) of the cover plate (1) against the trialing wall (35) of the groove;

then tensioning and holding the trailing end portion (38) of the cover plate in position against the trailing wall of the groove, while stretching the end portion of the cover plate against the bottom of the groove to stretch the cover plate about the circumference of the cylinder by a second holding strip (40);

and retaining the second holding strip in position until the adhesive has set or cured.

9. Method according to claim 1, wherein (FIG. 12) the printing cylinder (63) is formed with recess (69) adjacent the trialing edge (52) of the cylinder groove (64);

the cover plate (35) is cut to have a length such that the trailing end portion (38) fits into said recess;

and wherein the step of pressing and adhering the cover plate on the printing cylinder comprises applying a pressure roller (70) with a resilient circumference against the cover plate on the printing cylinder, while rolling off the printing cylinder against the pressure roller and engaging the resilient surface of the pressure roller (70) in the recess (69) of the cylinder by deformation of the surface thereof to thereby angle off the trailing end portion of the cover plate and fit the trailing end portion in the recess (69) in the slot (64) of the cylinder for adhesion of the trailing end portion of the plate into said recess.

10. The method of claim 1 wherein said flexible plate (1) comprises a thin sheet of stainless steel.

11. Method according to claim 1, wherein the step of adhering the trialing end portion (4, 38, 68) of the cover plate (1, 36, 65) to the trailing surface (35, 54, 69) of the groove comprises adhering said trailing end portion of the cover plate by a pressure sensitive adhesive.

12. The method of claim 1, wherein said flexible plate (1) comprises a thin sheet of corrosion resistant material.

13. Apparatus for pre-forming a printing cylinder cover plate (1) to form a protective cover plate for application on a printing cylinder having an axially extending cylinder groove, comprising a pre-form, or dummy cylinder (11) formed with a cylinder groove (12);

a support rail (13) mounted in the cylinder groove;

a first holding strip (19) crew-connectable with the support rail;

means (21) for clamping the first holding strip (19) against a first wall (14) of the groove and for retaining a first end portion (3) of the cover plate (1) against the first wall of the groove;

a second holding strip (22) screw-connectable with the support rail;

means (24) for clamping the second support rail against an opposite wall (15) of the groove, and for controllably moving the second holding strip (22) in the direction of the bottom of the groove to pull an end portion (4) of the plate, engaged by the opposite wall of the groove in the direction of the bottom of the groove and to thereby tension the cover plate (1) about the circumference of the cylinder (11); and roller means (25) engageable against the circumference of the pre-form or dummy cylinder (11) with the cover plate (1) interposed, to thereby crease the first end portion (3) of the cover plate over the edge of the groove and bend the cover plate about the circumference of the pre-form or dummy cylinder upon rotation of the pre-form or dummy cylinder and, after such bending, to permit angling-over and creasing the second end portion (4) of the cover plate over the adjacent edge of the groove, and stretching of said cover plate about the circumference of the cylinder, by engagement with said second support rail.

14. A printing machine cylinder comprising a printing machine cylinder structure (30, 44, 50, 63);

and a flexible cover plate (1, 36, 65) adhered to the circumference of the cylinder structure, said cover plate including a double-side coated adhesive foil (2) positioned between the cover plate and the cylinder structure and, respectively, adhering the cover plate and the cylinder structure together;

said cylinder structure being formed with an axial groove (34, 47, 65), said cover plate and adhesive foil extending into at least a portions of the groove at one end portion of the cover plate, the other end portion (4) of the cover plate being free from said double-side coated adhesive foil, and being adhered to a respective inner wall portion of the groove.

15. The cylinder of claim 14, wherein said foil is interrupted, adjacent the one end portion (3) of the cover plate (1) leaving a transversely extending gap (5), the leading edge (51) of the groove of the cylinder being received in said gap.

16. The cylinder of claim 15 wherein the foil terminates adjacent the trailing edge (52) of the groove of the cylinder, to thereby leave the leading and trailing edges (51, 52) of the groove of the cylinder free form foil;

and herein the trailing end portion (4) of the cover plate is adhered to a wall portion of the groove by at least one of: a contact adhesive; a liquid adhesive.

17. The cylinder of claim 14 wherein said flexible plate (1) comprises a thin sheet of stainless steel.

18. The method of claim 14, wherein said flexible plate (1) comprises a thin sheet of corrosion resistant material.

* * * * *